US006880479B2

(12) United States Patent
Low

(10) Patent No.: US 6,880,479 B2
(45) Date of Patent: Apr. 19, 2005

(54) INFLATABLE ANCHOR LIFT

(76) Inventor: Clint Low, 21417 Blessinger Rd., Star, ID (US) 83669

( * ) Notice: Subject to any disclaimer, the term of this patent is extended or adjusted under 35 U.S.C. 154(b) by 0 days.

(21) Appl. No.: 10/630,821

(22) Filed: Jul. 29, 2003

(65) Prior Publication Data

US 2005/0022714 A1 Feb. 3, 2005

(51) Int. Cl.[7] ..... B63B 21/24
(52) U.S. Cl. ..... 114/297
(58) Field of Search ..... 114/294, 297, 300, 114/301, 54

(56) References Cited

U.S. PATENT DOCUMENTS

| | | | | |
|---|---|---|---|---|
| 906,716 | A * | 12/1908 | Jelpo | 114/54 |
| 2,508,800 | A * | 5/1950 | Rinnie | 114/54 |
| 3,608,510 | A | 9/1971 | DeVries | 114/54 |
| 3,950,806 | A | 4/1976 | Puchois | |
| 4,067,287 | A | 1/1978 | Sabella | 114/299 |
| 4,697,706 | A * | 10/1987 | Schaller | 206/573 |
| 5,373,801 | A | 12/1994 | Spickelmire | 114/299 |
| 5,432,757 | A * | 7/1995 | Chelminski | 367/144 |
| 5,690,047 | A * | 11/1997 | Holmes | 114/294 |

OTHER PUBLICATIONS

Printout of website, Tigerboatdocks.com, dated Apr. 17, 2003.
Printout of website, Diversdiscount.com, dated Apr. 17, 2003.

* cited by examiner

*Primary Examiner*—Sherman Basinger
(74) *Attorney, Agent, or Firm*—Pedersen & Co., PLLC; Ken J. Pedersen; Barbara S. Pedersen

(57) ABSTRACT

A buoyancy powered device for raising or assisting in raising anchors from the bottom of a body of water. The device is remotely inflated through a hose that is preferably placed inside a protective outer shell. The rope attached to the anchor is also preferably placed inside the shell, but is not attached to the hose so that the hose is not required to bear any of the weight of the anchor or to keep the watercraft secured to the anchor. At various locations along the line are provided loops or other attachment devices that can be used to attach the rope to the boat at various lengths as desired. Preferably, when deflated, the float can be temporarily secured in a compact rolled-up or folded configuration near the anchor line, by a securement system that allows the float to come unrolled or unfolded during inflation of the float.

18 Claims, 5 Drawing Sheets

INFLATABLE ANCHOR LIFT

BACKGROUND OF THE INVENTION

1. Field of the Invention

This invention relates to devices for raising anchors from the bottom of a body of water to the surface of the water, and more particularly to devices that raise anchors by means of buoyancy created by inflating part of the device with air.

2. Related Art

Some methods for using inflated bags to lift anchors or other objects to the surface of a body of water are known in the prior art. For example, Spickelmire (U.S. Pat. No. 5,373,801) discloses a method using a float and the movement of a boat to lift a submerged object. A rope is tied to the submerged object and passed through a device attached to the float that allows movement of the rope only in one direction. The rope is then connected to the boat. The boat is driven away from the float in order to pull the rope through the one-way device. Once the submerged object is raised, the float and object may be pulled into the boat.

Holmes (U.S. Pat. No. 5,690,047) discloses a float attached to an anchor that is remotely inflated. The float is connected to an air pressure generator on the surface via a flexible conduit that is generally coextensive with the line or cable used to raise or lower the anchor. The Holmes float surrounds and is coaxial with the rod of the anchor, so that the float is generally a "dough-nut" shape around the anchor directly above and closely adjacent to the "prongs" of the anchor. The air hose extends along the anchor rope and is clamped to the anchor rope.

In some situations, it may be inconvenient or even impossible to use a device such as Spickelmire's because there is insufficient available space to use the boat to lift or because it would require rowing a small watercraft upstream. The Spickelmire device is particularly impractical for rivers or crowed bodies of water where there is little room for the boat to maneuver or travel. Holmes device would tend to become compacted around the anchor prior to inflation, which creates a risk that a hard object such as a rock could become lodged between the float and the anchor adding weight and possibly puncturing the float. Also, the hose is clamped to the rope making it subject to the tension between the boat and anchor, which it is not capable of handling. Thus, there is a need for an improved buoyant anchor-lifting mechanism.

SUMMARY OF THE INVENTION

The present invention comprises a buoyancy device for raising, or assisting in raising, an anchor from a body of water. The device includes an inflatable float unit near the anchor, a connection system that connects the anchor to the boat and bears the weight of the anchor and the forces of pulling or lifting the anchor, and an inflation system that provides gas to inflate the float when needed to raise the anchor. The preferred embodiment uses a combined connection and inflation system that is adapted to prevent inflation hose crimping or stress. The preferred embodiment also comprises a system for securing the float unit, when deflated, into a compact, convenient shape that is not cumbersome and clumsy for the user to handle and store.

The combined connection system and inflation system preferably comprises an anchor rope/line and an inflation hose running generally parallel and adjacent to each other inside a protective outer shell. The float unit is remotely inflated through the hose. Preferably, the rope, while being inside the shell with the hose, is not attached to the hose so that the hose is not required to bear any of the weight of the anchor or to keep the watercraft secured to the anchor. At incremental lengths along the rope are placed loops or other attachment devices for attachment to the boat at incremental locations along the rope to adjust the distance of the boat from the anchor.

Preferably, the float unit is connected to or integral with the connection system only along one edge of the float, which results in the inflated float unit extending outward and away from the connection system. Preferably, the float unit does not extend on or around more than one side of the connection system, and does not comprise more than one inflatable bladder/bag. This way, the connection system, and the forces that are inherent in the anchor being pulled/lifted, are only placed on one edge of the float unit and not through a central portion of the float. Most preferably, the inflatable bladder in contained inside of, but is not fixed to, a protective cover and it is an outer edge of the protective cover that is integral with or securely connected to the connection system. This way, the bladder's buoyancy lifts the float unit protective cover, which lifts the connection system, and, hence, the anchor. This way, the bladder is not stressed or compressed by the forces caused by the weight of the anchor or by pulling on the connection system.

The float unit is also at a significant distance from the anchor, so that there is not a significant risk of entanglement or interference with the anchor or with rocks, plants or debris at the bottom of the water. The preferred float may be rolled-up toward the connection system, or the edge of the float that is integral with the connection system, and secured into a generally tubular/cylindrical roll parallel to the length of the line. Also, the mechanism securing the float in its rolled-up position allows the float to come unrolled during inflation of the float.

In use, the anchor and the preferred float unit are placed over-board, with the float rolled up and secured in the rolled-up position. The anchor is used in conventional manner, until the time when it is to be raised. The user then sends air through the air hose to the float, the pressure of which expands and opens the float, and the buoyancy of the float lifts the float and therefore the anchor upwards. The float rises to the top of the water, preferably with a top handle being in an upwards orientation, so that the user may grasp the handle and also the rope/line to lift the float and the anchor below it into the boat. By using the invented anchor lift system, the user need only lift the float unit and anchor a couple feet, from the water surface to the boat, rather than many feet from the bottom of the lake or river to the boat.

DETAILED DESCRIPTION OF THE INVENTION

Referring to the Figures, there is shown one, but not the only, embodiment of the anchor lifting system. The preferred embodiment of the anchor lifting system includes an inflatable container, referred to hereafter as a float, pneumatically connected to a source of compressed gas. While deflated, the float is connected to an anchor and lowered therewith. When the compressed gas is fed into the submerged float, an upward buoyant force is produced, which raises the anchor or assists in doing so. Preferably, the float can be rolled up or otherwise compacted when deflated and will automatically expand/unroll during inflation. Also, the preferred float includes a handle at its uppermost point, to assist the user in retrieving the device and the attached anchor from the water.

Figure 1:
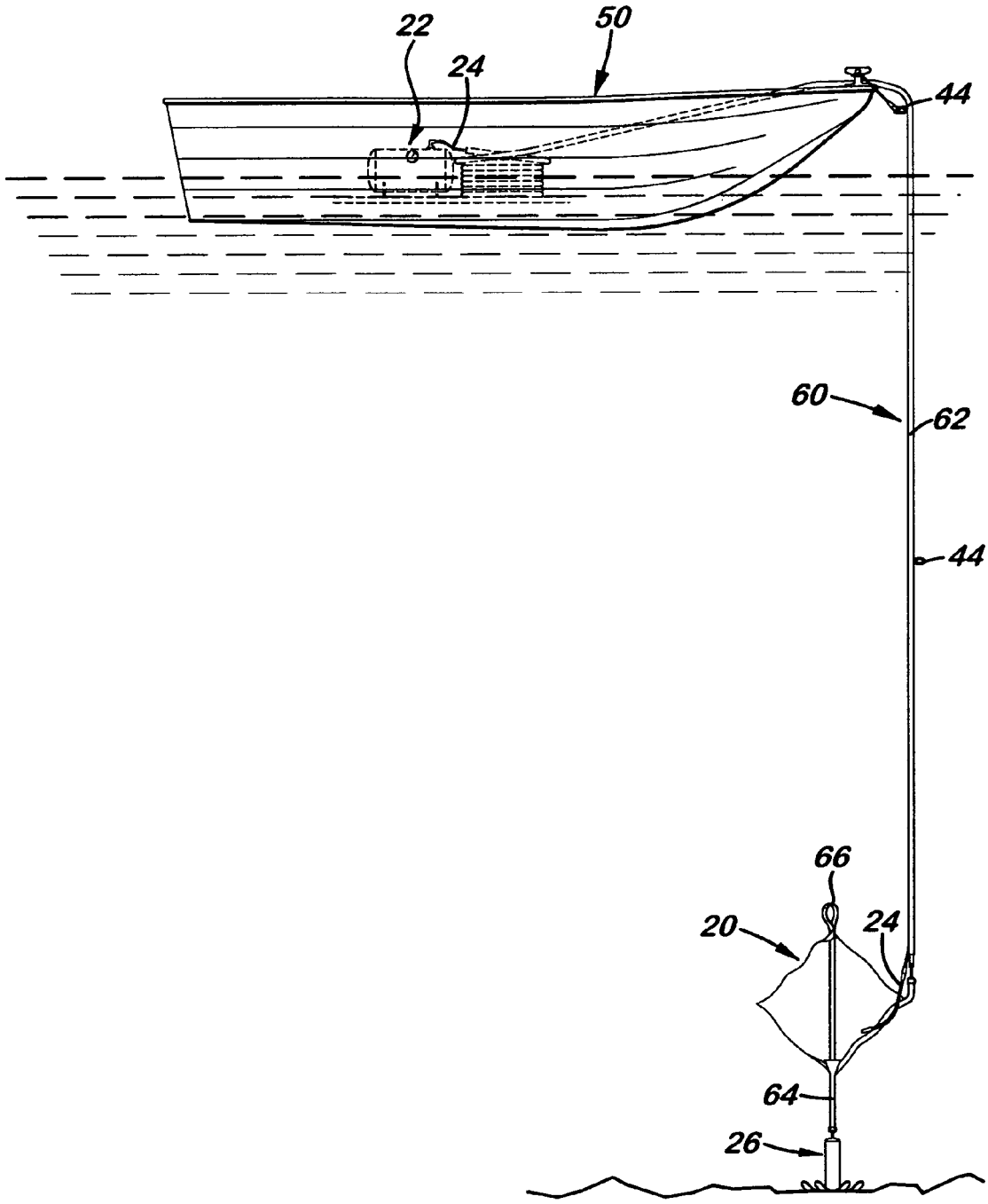
FIG. 1 shows one embodiment of the invented anchor lift system in use, connected to a submerged anchor and an air compressor and inflated for beginning the lifting of the anchor.

Referring specifically to the figures, FIG. 1 illustrates the preferred anchor lifting system 10 in use, after inflation of the float 20. An air compressor 22 is hydraulically connected to the float 20 via an air or other gas hose 24. The float 20 is shown inflated, but with the anchor 26 still on the bed of the body of water, with its prongs 28 either on the bottom of the lake or river or wedged between rocks or other objects on the bottom. The shaft 30 of the anchor, therefore, is typically upright or at an angle relative to the surface of the water. The anchor line (or rope) 40 is attached to the boat with a loop 44 in the line 40 attached to a cleat 46 extending from the boat's bow or over another connector on the boat. The hose 24 and the line 40 extend from the boat 50 to near the anchor, generally parallel and closely adjacent in a combined hose-line unit 60. The combined hose-line unit 60 preferably includes a hollow sheath 62 substantially encasing both the hose 24 and line 40, to protect them, keep them close and parallel, and to make the combination 60 a neater and more easily coiled and stored device. The hose and line preferably are not attached to each other inside the sheath 62, but loosely run through the sheath 62 together side-by-side, so that force on the line 40 does not impart force on the gas hose 24.

Because an air compressor requires electrical power and can be excessively noisy, the air compressor 22 may be replaced by a tank of compressed gas. For example, a five gallon, 125 psi air tank may be used for a two to three foot square by six inch thick float. Air is the preferred gas primarily for cost and availability reasons, but other gases, such as carbon dioxide, may be used.

Figure 2:
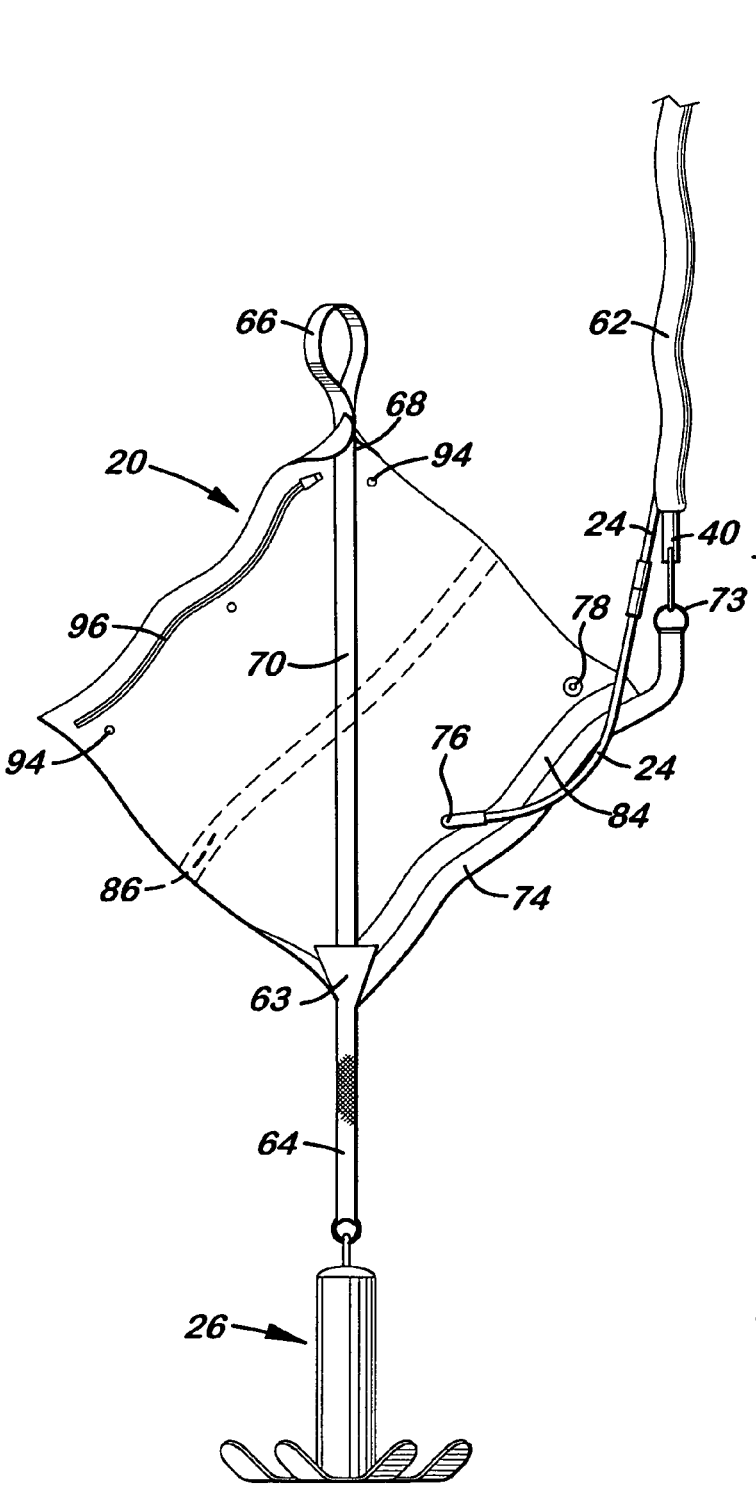
FIG. 2 is a close-up front view of the float embodiment of FIG. 1 attached to an anchor.

FIG. 2 shows a closer view of the preferred embodiment. The preferred float 20 is rectangular (most preferably square) in shape with the anchor 26 connected to one corner (lower corner 63) via a strap 64. A handle 66 is attached to the opposite corner (upper corner 68), as this corner 68 will typically be the highest part of the float 20 when in use and inflated. The anchor line 40 is preferably attached to one of the other two corners of the float (side corner 72) at a line connection 73. The float 20 is reinforced all along the axis between the line connection at side corner 72 and the lower corner 63, preferably with a strap 74 that is integral with or very securely connected to the anchor strap 64 and the line connection 73. Thus, the float may be said to extend integrally from the connection system for connecting the anchor to the boat. The connection system is the structure that bears the weight/force of the anchor, and, in the preferred embodiment is the line 40, line connection 73, strap 74, and strap 64, but in other embodiments may be a single rope/ine or another combination of typically flexible straps/lines connected in series to extend from the watercraft to the anchor. While there may be connecting straps between the line 40 and the anchor, or between the line 40 and the boat, still the line 40 may be said to "connect at one end to the boat and connect at its other end to the anchor."

Other shapes besides rectangular floats may be used, for example, a semi-circular float being attached at its straight edge to the rope/line, or a triangular float being attached at one straight edge to the rope/line. While a straight edge of a float is preferred for connection to the rope/line, and it is preferred that that straight edge is at least one foot long, other configurations may be used, depending upon the size of the float, the size of the anchor, and the securement mechanism chosen for quick-release upon inflation. The rectangular shape, however, provides a convenient shape for ease of rolling up, for convenient placement of handle placement, and good force vectors when the float is inflated and floating to the top of the water.

The float 20 is preferably reinforced continuously along the axis between the handle 66 and the lower corner 63, to support the weight of the anchor when pulling it out of the water by means of the handle. This reinforcement may be done, for example, with a strap 70 sewn along that axis and integral with or securely connected to the handle 66.

Figure 8:
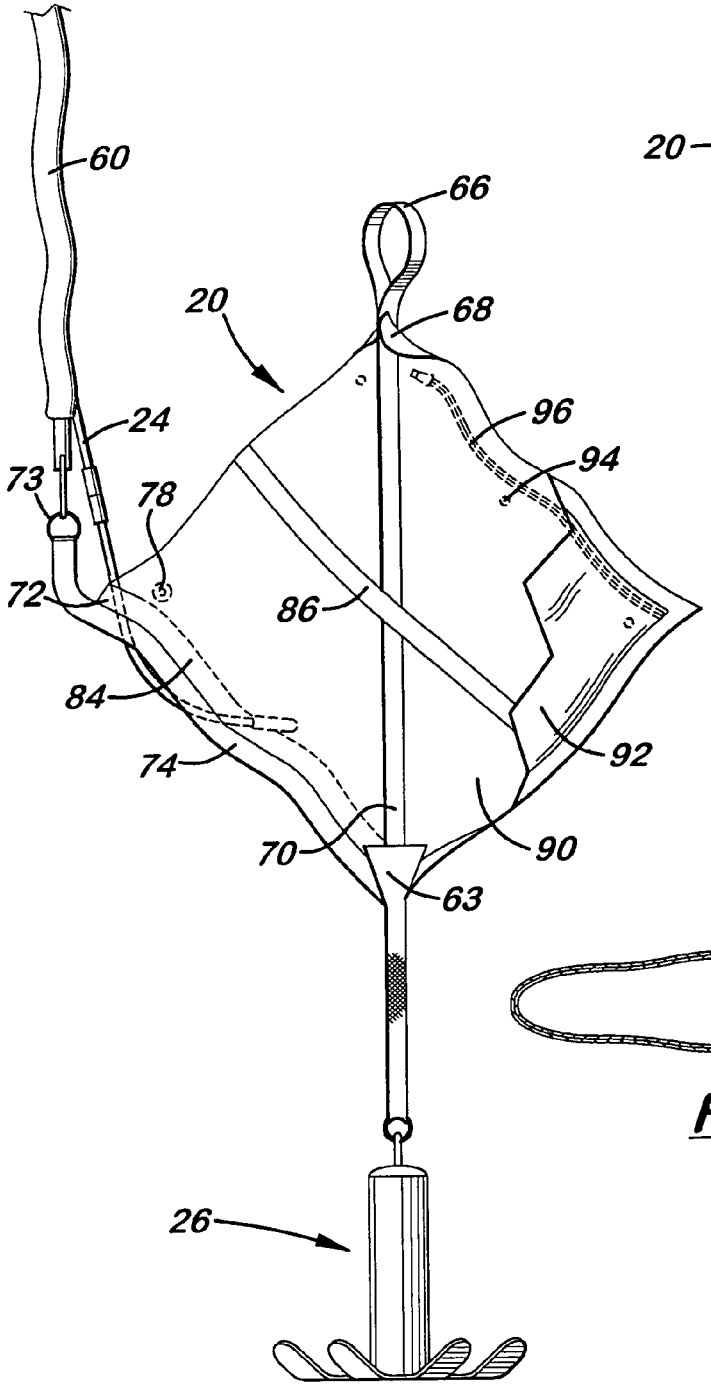
FIG. 8 is a close-up back view of the embodiment of FIGS. 1–4, with a section of the outer cover removed to reveal the inner air bladder.

The float 20 preferably has two parts, as shown in FIG. 8: an inner inflatable bladder 92 made of polyurethane that is ultrasonically welded together and an outer covering 90 made of rubberized nylon or PVC-coated polyester. The preferred float 20 also has a pressure release valve 76 to prevent the float from becoming over-pressurized and rupturing.

Figure 3:
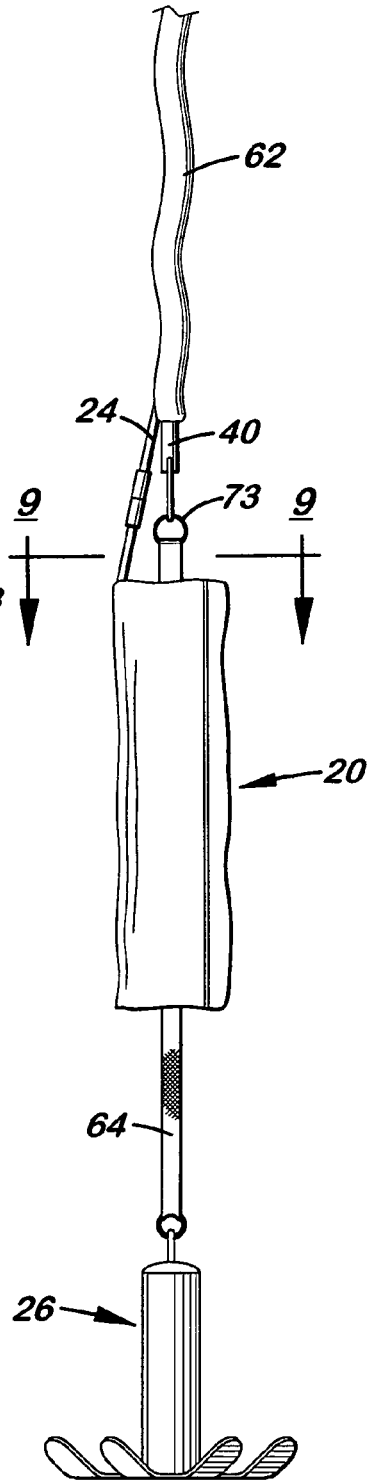
FIG. 3 is a close-up side view of the embodiment of FIGS. 1 and 2 showing the preferred float deflated and rolled-up, as it would be before inflation and lifting of the anchor.
Figure 9:
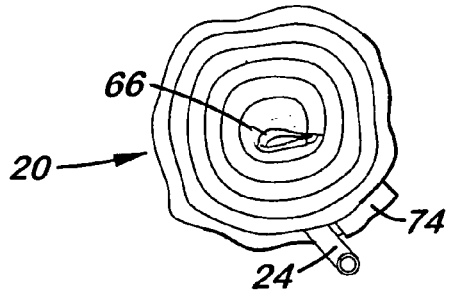
FIG. 9 is a cutout top view of the embodiment of FIGS. 1–4, as rolled up in FIG. 3.

FIGS. 3 and 9 illustrate the preferred float's ability to roll-up compactly when it is deflated. Preferably, a hook-and-loop fastener system secures the float 20 in the rolled-up position. The hook-and-loop fasteners are positioned on the front and back of the float. On the front, a first strip of hook-and-loop fastener 84 is preferably placed at or near the edge where the hose and line connect to the float 20. A parallel second strip of hook-and-loop fastener 86 is placed about the middle of the bag on the bag. The float 20 is rolled from the edge opposite the first strip of hook-and-loop fastener 84 such that the two strips meet and attach to one another, thus, forming a generally cylindrical rolled-up float hanging on the rope/line. While inflating, the air pressure into the float forces it to unroll. Preferably, only the hook-and-loop fasteners are used to secure the float 20 in the rolled-up position, or, less preferably, snaps or other quick-release fasteners that easily unfasten or unlatch due to the force caused by inflating the float. Because the float 20 is rolled-up and compact, and is preferably about 1–2 feet above the anchor, the danger that the float will become caught on an object on the bed while deflated or while inflated is significantly reduced.

Figure 4:
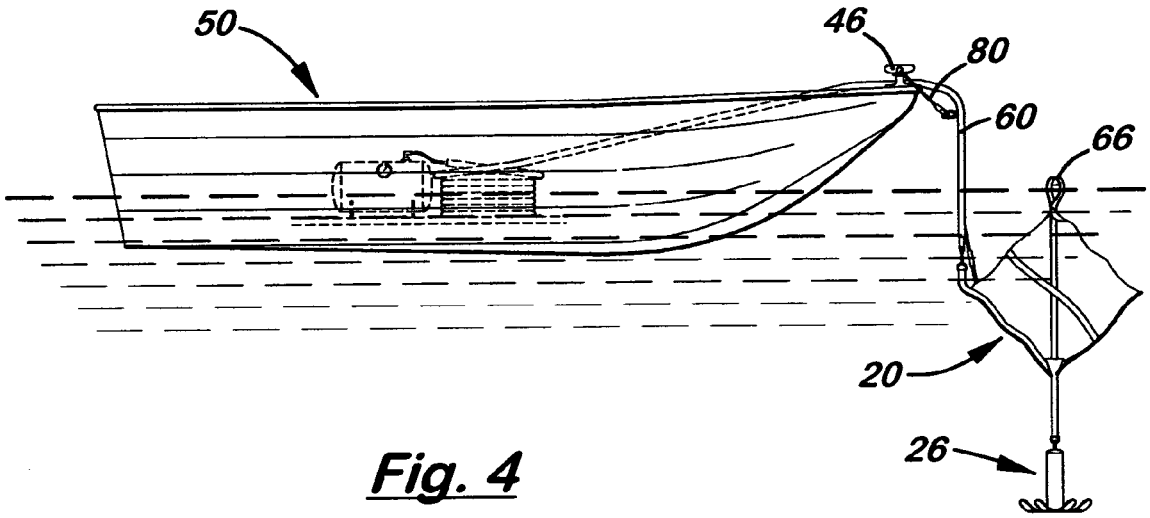
FIG. 4 shows the embodiment of FIGS. 1, 2, and 3 in use connected to an air compressor and an anchor, after the float has been inflated and has raised the anchor to near the surface.

FIG. 4 illustrates the preferred embodiment in use with an air compressor 22 and the float 20 shown with the handle only piercing the surface of the water. Generally, even if this is as high as the float 20 will come via its buoyant force, the user may easily reach the handle 66 with one hand, and the line 40 or the line connection 73 with the other hand, and may easily pull the unit up out of the water into the boat. This operation is substantially easier than pulling a long line hand-over-hand the many feet or yards that is necessary to pull the anchor all the way from the bottom of the water.

Figure 5:
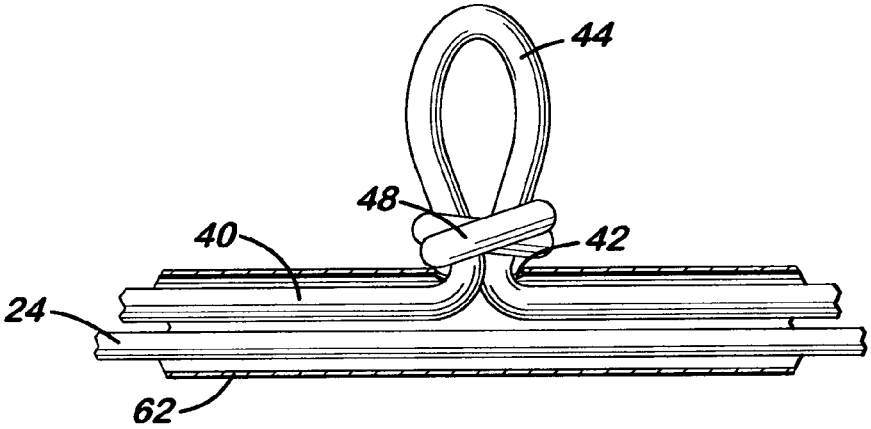
FIG. 5 is a side view of one embodiment of the air hose and line combination, showing one embodiment of a protruding loop of line.

FIG. 5 shows a close up view of the hose and line combination 60 of the preferred embodiment. The hose 24 and line 40 are not tied or clamped together, not at either end or anywhere along the length of the hose and line. This keeps the hose 24 from having to support the weight of the anchor 26 and prevents or helps to prevent the hose being pulled, crimped, torn, or otherwise blocked or damaged. At intervals along the line 40, the rope forms a loop 44 that can be used to attach the rope to the boat at various lengths as desired. The loops 44 are preferably formed by the rope exiting and reentering the sheath 62 separately from the air hose.

This results in the formation of a small loop 44 of line outside the protective sheath 62, wherein the loop is therefore integral with the line 40. Preferably, a knot 48 in the line 40 prevents the loop 44 from sliding into the sheath 62 through the hole 42, resulting in the knot 48 also being integral with the line. The sheath is preferably not connected to either the line 40 or the hose 24, but, because the loops 44 are secured outside the sheath 62, some force related to the line 40 bearing the weight of the anchor may be felt by the sheath 62. Other systems for keeping the loops from sliding into the sheath may be used, for example, a non-integral system such as a band or clip around the line at the base of the loop, as long as it will not break open. Also, alternatively, other attachment means besides the knotted loops may be made to attach the line to the boat at various locations along the line. For example, hooks or fasteners may extend from the line through the holes in the sheath to attach to the boat, as long as the hooks or fasteners are well secured to the line.

The preferred line hose combination 60 is about 100 feet long, and loops 44 are preferably placed every 20 feet along the line 40 after the first loop 44, which is placed 40 feet from the anchor 26. Other line lengths and intervals may be used. The outer sheath 62 is preferably made from nylon tubular webbing. The line and hose combination 60 may be produced by forcing a fish tape through a length of nylon tubular webbing. The fish tape is then used to pull a small rope through the webbing, which is in turn used to pull the line 24 and hose 40 through the webbing. Other methods of threading the line 40 and hose 24 through the webbing, or a cover may be otherwise formed around the line and hose combination.

Figure 6:
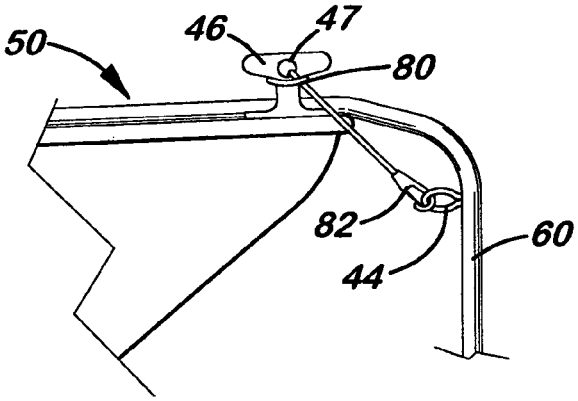
FIG. 6 shows the loop of line of FIG. 5 connected to a cleat on a boat rail.
Figure 10:
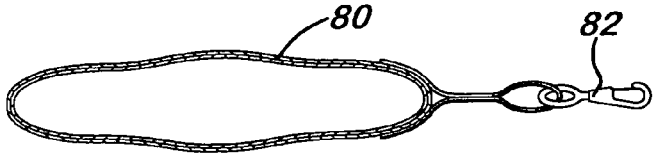
FIG. 10 is a top view of the loop and snap-hook used to connect the line to a cleat on a boat rail as depicted in FIG. 6.

The preferred method for connecting the line 24 to a cleat 46 on the boat utilizes a snap-hook 82 attached to a loop 80, as shown in FIG. 10. As illustrated by FIG. 6, the preferred method for connecting the line to the cleat 46 uses a snap-hook 82 with a loop 80. The loop 80 on the snap-hook 82 is passed through hole 47 in the cleat 46 and pulled over the cleat's prongs 48 or over the snap-hook 82 to secure it in place. The snap-hook 82 is then connected to the line via loop 44. Alternatively, the loop 44 in the line itself could be attached to the cleat 46 in the same manner as loop 80, or simply placed around the base of the cleat 46 or other protrusion on the boat 50.

Figure 7:
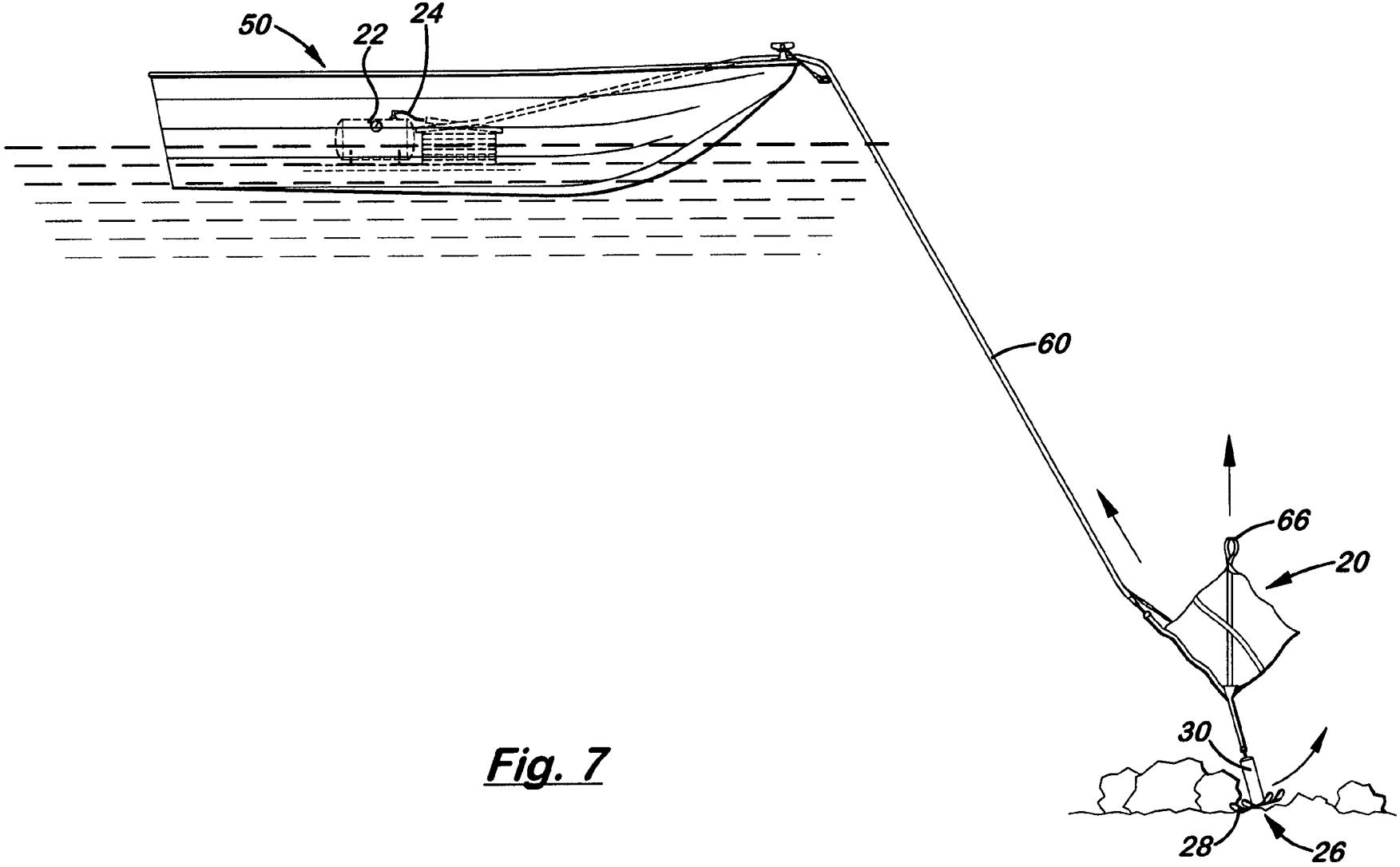
FIG. 7 shows the embodiment of FIGS. 1–4, with the float inflated, illustrating how the combination of the upward buoyancy force of the float may combine with the force from a boat pulling on the line, to dislodge an anchor from objects on the bottom of a body of water.

FIG. 7 illustrates how the float 20 and line 24 combine to free the anchor 26 from the bed. The float 20 provides generally upward force. To supplement this, if necessary, the boat may be used to pull on the line, to provide both upward and lateral force, as suggested by the arrow along the line in FIG. 7. The lateral component helps the anchor 26 to tip over, if necessary to lift it from rocks or other debris. This in turn allows the anchor's prongs 28 to change their angle relative to objects they may be caught on allowing the prongs 28 to slide free.

FIG. 8 illustrates the preferred two-part float. The inflating gas is supplied to the inner air bladder 92. The air bladder 92 is contained within outer covering 90. Holes 94 are placed in the covering 90 so that water, which tends to leak into the space between the air bladder 92 and the covering 90 when the float is deflated, will readily exit the space when the bladder 92 is inflated. The air bladder 92 may be accessed, for examination, repair, or replacement, through a zipper 96 in the outer covering 90.

Although this invention has been described above with reference to particular means, materials, and embodiments, it is to be understood that the invention is not limited to these disclosed particulars, but extends instead to all equivalents within the scope of the following claims.

I claim:

1. An anchor raising device comprising:

an anchor connection system connecting an anchor to a watercraft, said system comprising a line connected to said anchor at or near its first end and to said watercraft at or near its second end; and a compressed gas hose; and an inflatable container attached to the anchor connection system at an outer edge of said inflatable container;

wherein said compressed gas hose is pneumatically connected to said inflatable container; and wherein said line and said gas hose are generally parallel and closely adjacent, and the device further comprises a sheath enclosing the line and the gas hose, wherein said gas hose is not attached to said line or said sheath.

2. An anchor raising device comprising:

an anchor connection system connecting an anchor to a watercraft, said system comprising a line connected to said anchor at or near its first end and to said watercraft at or near its second end; and a compressed gas hose; and an inflatable container attached to the anchor connection system at an outer edge of said inflatable container;

wherein said compressed gas hose is pneumatically connected to said inflatable container; and wherein the anchor raising device further comprises an apparatus for tightly compacting said device comprising:

one or more first hook-and-loop pieces on a front surface of said inflatable container; and one or more second hook-and-loop pieces on a back surface of said inflatable container; wherein each of said first hook-and-loop pieces cooperates with one or more of said second hook-and-loop pieces to attach to each other when said inflatable container is rolled up to said outer edge to form a generally cylindrical shaped adjacent to the connection system.

3. The anchor raising device of claim 2 where said float will come unrolled when compressed gas enters said inflatable container from the compressed gas hose.

4. An anchor raising device comprising:

an anchor connection system connecting an anchor to a watercraft, said system comprising a line connected to said anchor at or near its first end and to said watercraft at or near its second end; and a compressed gas hose; and an inflatable container attached to the anchor connection system at an outer edge of said inflatable container;

wherein said compressed gas hose is pneumatically connected to said inflatable container; wherein said inflatable container comprises:

an inflatable inner bladder; and an outer housing; and wherein:

there is an interior space between said outer housing and said inner bladder, and said outer housing has one or more apertures between said interior space and the exterior of said outer housing adapted to allow water to flow out of said interior space through said apertures.

5. An anchor raising device comprising:

an anchor connection system connecting an anchor to a watercraft, said system comprising a line attached to said anchor and said watercraft;

a gas hose; and a flexible sheath containing said line and said gas hose;

an inflatable container attached to said anchor connection system near said anchor, wherein said inflatable container securely rolls up to near said anchor connection system;

wherein the gas hose is pneumatically connected to said inflatable container for inflating the inflatable container to lift the anchor at least in part by means of buoyancy of the inflated container; and wherein said inflatable container will remain rolled up until inflated through said gas hose.

6. The anchor raising device of claim 5, wherein said inflatable container is held in the rolled up position with:

one or more first hook-and-loop pieces on a front surface of said inflatable container; and one or more second hook-and-loop pieces on a back surface of said inflatable container;

wherein each of said first hook-and-loop pieces cooperates with one or more of said second hook-and-loop pieces to attach to each other when said inflatable container is rolled up to near said anchor connection system.

7. The anchor raising device of claim 5 wherein said gas hose is not attached to said line or said sheath.

8. The anchor raising device of claim 5 where said inflatable container comprises:

an inflatable inner bladder, and an outer housing.

9. The anchor raising device of claim 8 wherein:

there is an interior space between said outer housing and said inner bladder, and said outer housing has one or more apertures between said interior space and the exterior of said outer housing adapted to allow water to flow out of said interior space through said apertures.

10. An anchor raising device comprising:

an anchor connection system connecting an anchor to a watercraft, said system comprising a line connected to said anchor and said watercraft;

an gas hose, and a flexible sheath containing said line and said hose;

wherein said gas hose is not attached to said line or said sheath; and an inflatable container attached to said anchor connection system and pneumatically connected to said gas hose so that the inflatable container may be inflated to lift the anchor at least in part by means of buoyancy of the container.

11. The anchor raising device of claim 10 where said inflatable container comprises:

an inflatable inner bladder, and an outer housing.

12. The anchor raising device of claim 11 wherein:

there is an interior space between said outer housing and said inner bladder, and said outer housing has one or more apertures between said interior space and the exterior of said outer housing adapted to allow water to flow out of said interior space through said apertures.

13. An anchor raising device comprising:

an anchor connection system connecting an anchor to a watercraft, said system comprising a line attached to said anchor at its first end and attached to a boat at its second end;

a compressed gas hose, and a flexible sheath containing said line and said compressed gas hose; and an inflatable container attached to said anchor connection system and pneumatically connected to said compressed hose; and one or more openings in said sheath where said line exits and reenters said sheath forming a loop outside of said sheath, said loop being for connection to the watercraft.

14. The anchor raising device of claim 13 wherein said gas hose is not attached to said line or said sheath.

15. The anchor raising device of claim 13 with an apparatus for tightly compacting said device comprising:

one or more first hook-and-loop pieces on a front surface of said inflatable container; and one or more second hook-and-loop pieces on a back surface of said inflatable container;

wherein each of said first hook-and-loop pieces cooperates with one or more of said second hook-and-loop pieces to attach to each other when said inflatable container is rolled up to the length of said line.

16. The anchor raising device of claim 15 where said float will come unwrapped when said compressed gas enters said inflatable container.

17. The anchor raising device of claim 13 where said inflatable container comprises:

an inflatable inner bladder, and an outer housing.

18. The anchor raising device of claim 17 wherein:

there is an interior space between said outer housing and said inner bladder, and said outer housing has one or more apertures between said interior space and the exterior of said outer housing adapted to allow water to flow out of said interior space through said apertures.

* * * * *